US005553432A

United States Patent [19]

Levin

[11] Patent Number: 5,553,432

[45] Date of Patent: Sep. 10, 1996

[54] HORIZONTAL FORMING BLOCK WITH CURVED SIDE WALL FOR ARCHITECTURAL STRUCTURES

[76] Inventor: Michael Levin, 701 Brickell Ave., Suite 2600, Miami, Fla. 33131

[21] Appl. No.: 303,536

[22] Filed: Sep. 9, 1994

[51] Int. Cl.[6] ..... E04C 1/41

[52] U.S. Cl. ..... 52/309.12; 52/94; 52/421; 52/427; 52/439; 52/504; 52/606; 52/609

[58] Field of Search ..... 52/504, 608, 609, 52/94, 309.12, 606, 421, 427, 439; 446/125, 128; D25/116, 117, 118, 136

[56] References Cited

U.S. PATENT DOCUMENTS

| | | |
|---|---|---|
| 1,572,887 | 2/1926 | Dale . |
| 2,371,201 | 3/1945 | Wells . |
| 3,720,027 | 3/1973 | Christensen . |
| 4,026,086 | 5/1977 | Langley . |
| 4,107,894 | 8/1978 | Mullins . |
| 4,187,069 | 2/1980 | Mullins . |
| 4,439,967 | 4/1984 | Dielenberg . |
| 4,516,364 | 5/1985 | Heider . |
| 4,706,429 | 11/1987 | Young . |
| 4,884,382 | 12/1989 | Horobin . |
| 4,889,310 | 12/1989 | Boeshart . |
| 4,894,969 | 1/1990 | Horobin . |
| 5,086,600 | 2/1992 | Holland et al. . |
| 5,157,890 | 10/1992 | Jines . |

FOREIGN PATENT DOCUMENTS

| | | |
|---|---|---|
| 256279 | 12/1964 | Australia . |
| 2351632 | 4/1975 | Germany . |
| 2618125 | 4/1977 | Germany . |

*Primary Examiner*—Carl D. Friedman
*Assistant Examiner*—Christopher Todd Kent
*Attorney, Agent, or Firm*—Lott & Friedland

[57] ABSTRACT

A curved block formwork element for use in forming structures such as curved cornices, lintels and window sills. The curved block formwork element comprises a substantially rectangular shaped block having two oppositely disposed side walls and two oppositely disposed end walls creating a hollow cavity inside, wherein a first of the side walls comprises a flat surface and a second of the side walls comprises a curved surface; means for vertically interlocking the block with a plurality of rectangular block formwork elements along a top and bottom surface of the block; and means for horizontally interlocking the blocks.

15 Claims, 6 Drawing Sheets

HORIZONTAL FORMING BLOCK WITH CURVED SIDE WALL FOR ARCHITECTURAL STRUCTURES

TECHNICAL FIELD

This invention relates generally to a forming block with a curved side wall, and this invention specifically relates to a lightweight hollow horizontal forming block with interlocking surfaces and a curved side wall for concrete forming of cornices, window sills, lintels, overhang wind breaks, gutters and related supports and decorative elements used in architectural structures.

BACKGROUND OF THE INVENTION

Various types of concrete wall-forming structures have been employed in the construction industry for forming walls and other structures. The interlocking blocks are assembled and then the hollow formwork is filled with concrete to form a permanent structure.

Examples of such systems are described in U.S. Pat. No. 4,439,967 to Dielenberg; U.S. Pat. Nos. 4,884,382 and 4,894,969 to Horobin; and U.S. Pat. No. 5,086,600 to Holland et al., each of which is incorporated herein by reference.

U.S. Pat. No. 4,439,967 to Dielenberg describes an improved formwork element produced from hard foam resin material adapted to be filled with concrete to provide a rigid wall or like structure having high insulating properties.

U.S. Pat. No. 4,884,382 to Horobin, (the '382 patent), describes a modular concrete-block form with side panel members and end enclosure panels defining a cavity to receive poured concrete. The '382 patent further includes a plurality of strut members to prevent side-to-side movement.

U.S. Pat. No. 4,894,969 to Horobin, (the '969 patent), describes an improved insulating block formed from expandable polystyrene material to provide a lightweight box-like structure to receive concrete. The '969 patent further includes a pair of inserts for each end wall adapted to be mounted to the transverse strut member when the block is required to be cut.

Finally, U.S. Pat. No. 5,086,600 to Holland et al. describes a block for concrete wall construction made of lightweight plastic, having interlocking surfaces and a hollow interior compartment, wherein the interlocking surfaces comprise an inverted V-shaped upper surface and a plurality of cylindrical plugs and the lower surfaces comprise a mirror image thereof. Holland further includes spanner ribs with a U-shaped notch extending through the interior compartment of the block to receive a reinforcing rod. The ends of the blocks are dammed off with U-shaped plugs.

A major problem with the above listed systems is that none of these systems provide a curved side wall for concrete forming of cornices, window sills, lintels, roof overhang wind breaks and related supports and decorative elements used in architectural structures.

A possible solution to this problem is to provide a system that provides a curved side wall for such purposes, by using an interlocking concrete forming block.

Thus, there has been a need in the art for a system that provides a curved side wall for concrete forming of cornices, window sills, lintels, roof overhang wind breaks and related supports and decorative elements used in architectural structures.

SUMMARY OF THE INVENTION

The present invention solves significant problems in the art by providing a curved block formwork element for use in forming structures such as curved cornices, lintels and window sills.

Generally described, the present invention provides a curved block formwork element for use in forming structures, comprising a substantially rectangular shaped block having two oppositely disposed side walls and two oppositely disposed end walls creating a hollow cavity inside, wherein a first of the side walls comprises a flat surface and a second of the side walls comprises a curved surface; means for vertically interlocking the block with a plurality of rectangular block formwork elements along a top and bottom surface of the block; and means for horizontally interlocking the blocks.

Accordingly, it is an object of the present invention to provide a curved block formwork element for use in forming structures such as curved cornices, lintels, and window sills.

It is another object of the present invention to provide a means for vertically interlocking the block with a plurality of rectangular block formwork elements along a top and bottom surface of the block.

Accordingly, it is a feature of the invention is that the curved surface of the side wall is shaped as a quarter circular element having a closed circular bottom and an open horizontal top.

An advantage of the invention is that the blocks are made of lightweight insulating material.

These and other objects, features, and advantages of the present invention may be more clearly understood and appreciated from a review of the following detailed description of the disclosed embodiments and by reference to the appended drawings and claims.

BRIEF DESCRIPTION OF THE DRAWING FIGURES

FIG. 1*a* is a top perspective view showing an interlocking concrete forming block according to the invention.

FIG. 1*b* is an end view of the interlocking concrete forming block showing the U-shaped openings according to the invention.

FIG. 1*c* is a top plan view of the interlocking concrete forming block showing the interlocking means according to the invention.

FIG. 1*d* is a partial perspective view of the preferred male and female connecting means according to the invention.

FIG. 2*a* is a top perspective view showing an interlocking concrete forming block having a curved side wall according to the invention.

FIG. 2*b* is a side view of the interlocking concrete forming block having a flat side wall according to the invention.

FIG. 2*c* is a side view of the interlocking concrete forming block having a curved side wall according to the invention.

FIG. 2*d* is a top view of the interlocking concrete forming block having a curved side wall according to the invention.

FIG. 2*e* is an open end view of the interlocking concrete forming block having a curved side wall according to the invention.

FIG. 2*f* is a closed end view of the interlocking concrete forming block having a curved side wall according to the invention.

DETAILED DESCRIPTION OF THE PREFERRED EMBODIMENT

Figure 1A:
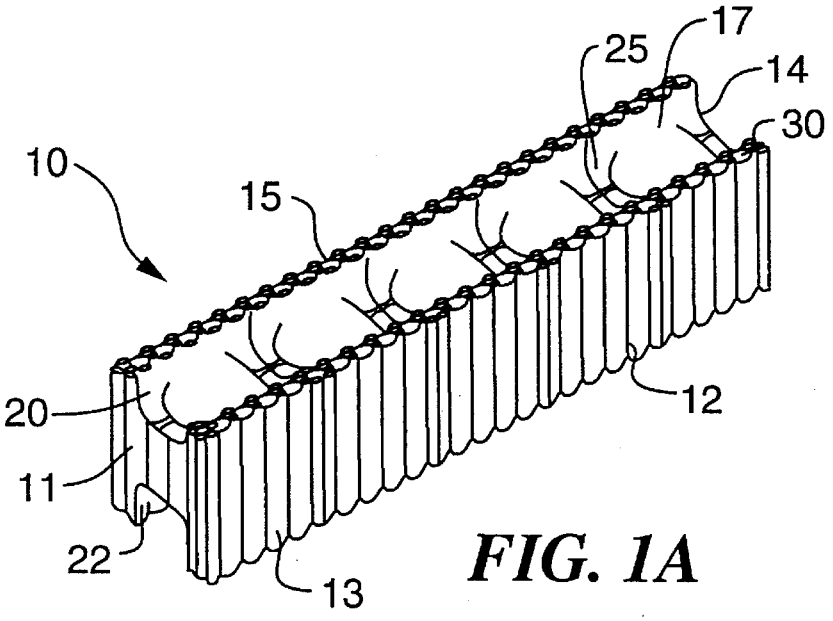
Figure 1B:
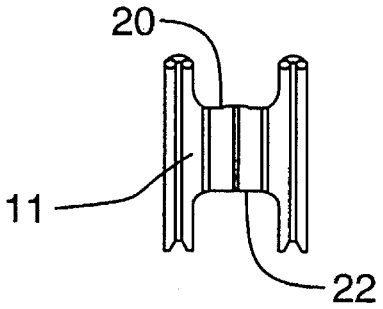
Figure 1C:
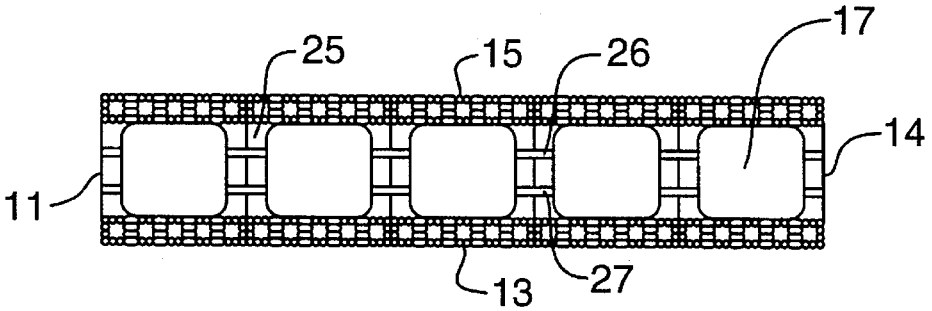

Referring initially to FIG. 1*a–d* of the drawings, in which like numerals indicate like elements throughout the several views, in a preferred embodiment the interlocking concrete forming block of this invention are generally illustrated by reference numeral 10.

In a preferred embodiment, the interlocking concrete forming blocks 10 comprise a body 12, and two ends 11, 14. The ends 11, 14 comprise a flat surface with U-shaped openings 20, 22. The forming blocks 10 are laid one on top of the other to form a vertical facing that is then filled with concrete to form the wall with excellent structural and insulating properties.

The forming block 10 has a substantially elongated body 12 defined by oppositely disposed side walls 13, 15 and ends 11, 14. The walls 13, 15 and ends 11, 14 define a box-like structure, which is preferably made from expanded polystyrene foam or like synthetic material, which further defines a body cavity 17. The polystyrene foam functions both as permanent planking and insulation. The body cavity 17 is further defined by a plurality of cross-struts 25 with U-shaped openings 20, 22. The struts 25 form the necessary support for the side walls 13, 15. Additionally, the forming block 10 is grooved and can be cut into multiples, with a regular tooth saw, along the struts 25 such that ends with U-shaped openings 20, 22 will be formed. The U-shaped openings 20, 22 allow for the poured concrete to flow between horizontally adjacent blocks.

Figure 1D:
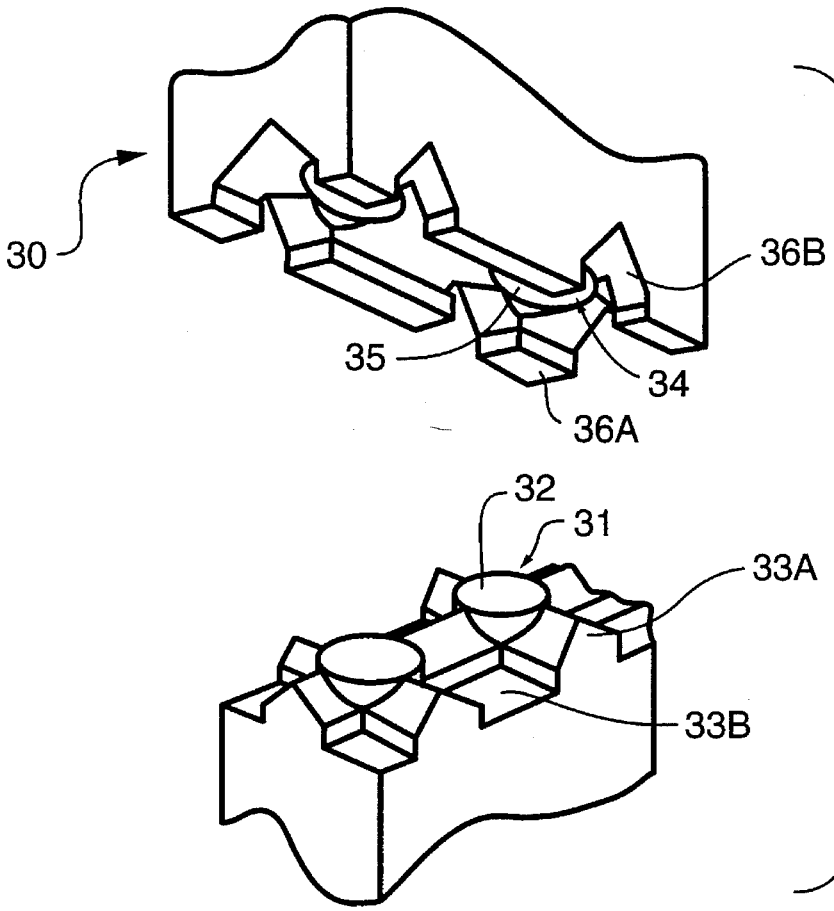

Turning now to FIG. 1*d*, an interlocking means 30 is provided such that the forming blocks 10 are readily stackable. The interlocking means 30 comprises a plurality of male connectors 31 on the top edge of the forming block 10 which fit into a plurality of female connectors 34 on the bottom edge of the forming block 10 which is stacked on top. This forms a rigid, unified assembly, capable of supporting the vertical pressure of pumped concrete.

Specifically, the male connectors 31 include pegs 32 and prism shaped members 33*a* which run along the top edges of the block. The pegs 32 protrude from the upper surface and the four prism shaped members 33*a* which further grip the blocks are located around each peg. Between each of the prism members are recesses 33*b*.

The female connectors 34 include sockets 35 and prism shaped members 36*a* which run along the bottom edges of the block. The sockets 35 of the female connectors 34 are round holes of about the same dimensions as the pegs 32. The prism shaped members 36*a* and their respective recesses 36*b* are designed to fit firmly into the prism shaped members 33*a* and recesses 33*b* of the male connectors 31.

In order to provide greater stability and support, reinforcing bars may be inserted within the cavity along horizontal channels 26, 27.

The blocks are interlocked vertically by stacking one block on top another such that the male connectors 31 on the upper edges of the blocks fit into the female connectors 34 on the lower edges of the blocks. Specifically, the pegs 32 fit into the sockets 35 and the prism shaped members 36*a* and their respective recesses 36*b* fit firmly into the prism shaped members 33*a* and recesses 33*b*.

Figure 2A:
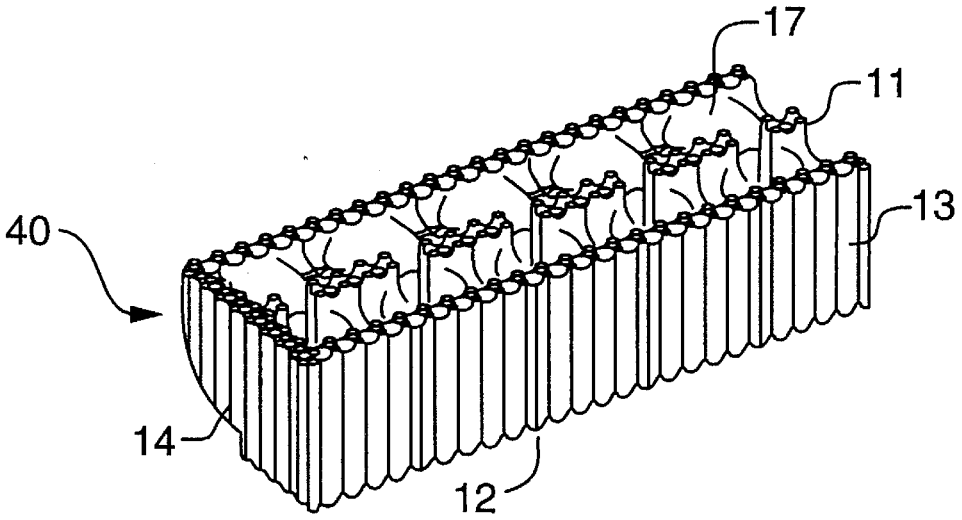
Figure 2C:
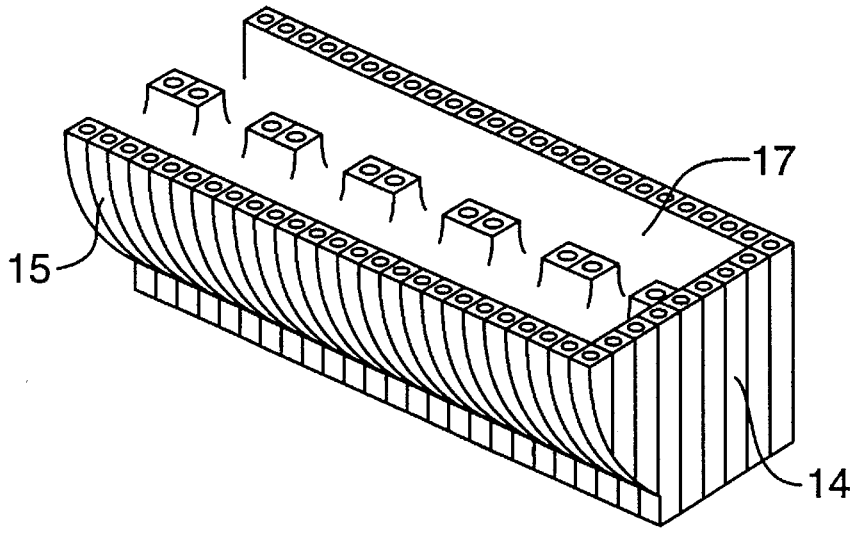
Figure 2B:
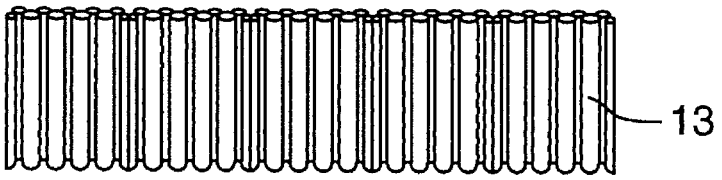
Figure 2E:
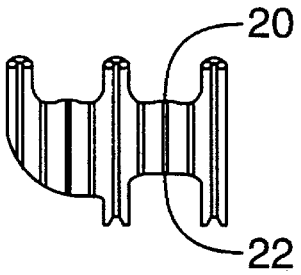
Figure 2F:
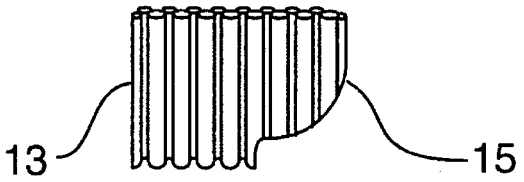
Figure 2D:
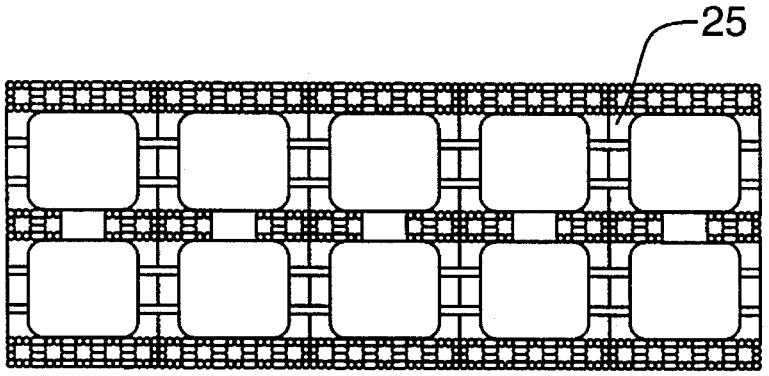

In an alternate embodiment, shown in FIGS. 2*a–f*, the forming block 40 comprises a body 12, a flat side wall 13, a curved side wall 15, and two ends 11, 14. The ends 11, 14 comprise a flat surface with U-shaped openings 20, 22 (FIG. 2*e*), or a closed end surface (FIG. 2*f*). The curved side wall 15 is in the shape of a quarter of a circle. The curved side wall 15 is closed along a bottom circular edge thereof, and open along the horizontal top edge thereof.

The forming block 40 has a substantially elongated body 12 defined by oppositely disposed side walls 13, 15, namely a flat side wall 13, a curved side wall 15 and ends 11, 14. The walls 13, 15 and ends 11, 14 define a box-like structure, which is preferably made from expanded polystyrene foam or like synthetic material, which further defines a body cavity 17. The polystyrene foam functions both as permanent planking and insulation. The body cavity 17 is further defined by a plurality of cross-struts 25 with U-shaped openings 20, 22. The struts 25 form the necessary support for the side walls 13, 15. Additionally, the forming block 40 is grooved and can be cut into multiples, with a regular tooth saw, along the struts 25 such that ends with U-shaped openings 20, 22 will be formed. The U-shaped openings 20, 22 allow for the poured concrete to flow between horizontally adjacent blocks.

Figure 3:
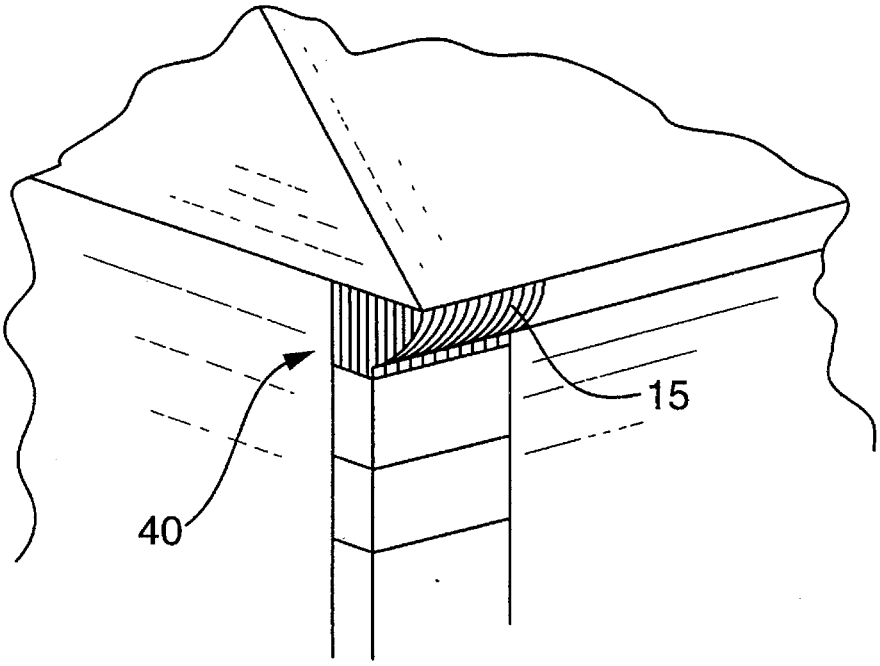
FIG. 3 is a perspective view showing a number of interlocking concrete forming blocks used to form the cornice of a building.

Turning now to FIG. 3, the forming block 40 is horizontally and vertically connected to the concrete forming blocks 10 to form, for example, a curved vertical facing that is then filled with concrete to form the cornice of a building structure with excellent structural and insulating properties. In this example, the forming block 40 is located under the eaves, or where the roof and side walls meet, forming a curved surface whereby the wind is directed away from underneath the eaves, helping to stabilize the roof on the structure from lifting with the forces of the wind.

Figure 4:
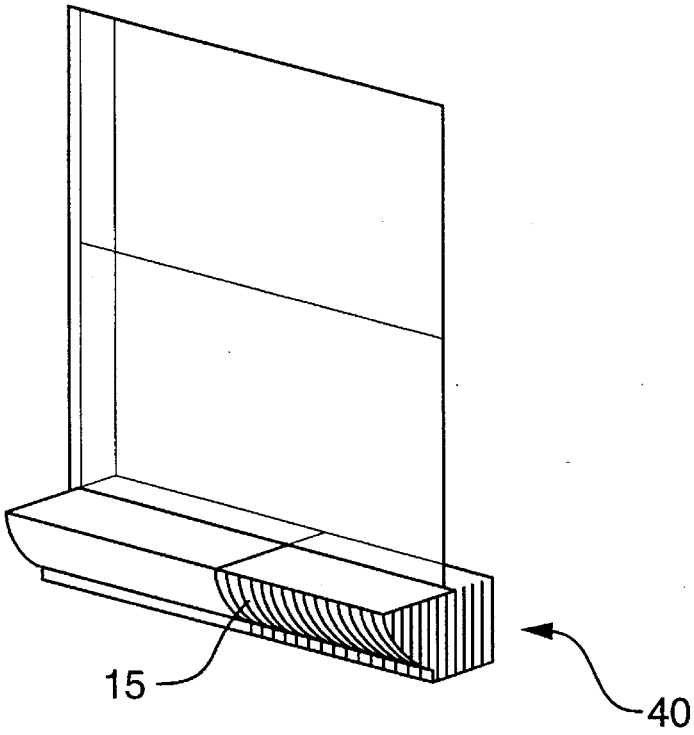
FIG. 4 is a perspective view showing a number of interlocking concrete forming blocks used to form a window sill.

Turning now to FIG. 4, the forming block 40 is horizontally and vertically connected to the concrete forming blocks 10 to form, for example, a curved exterior window sill.

Figure 5:
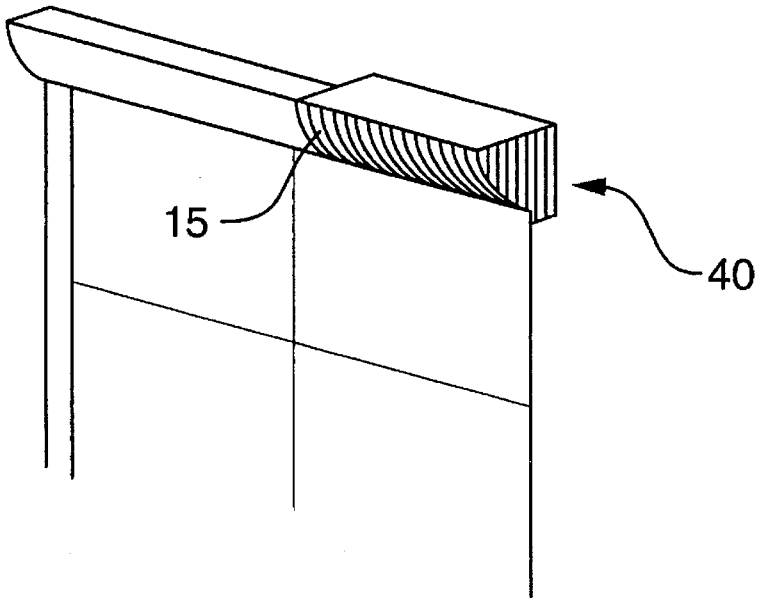
FIG. 5 is a perspective view showing a number of interlocking concrete forming blocks used to form a lintel above a door opening.

Turning now to FIG. 5, the forming block 40 is horizontally and vertically connected to the concrete forming blocks 10 to form, for example, a lintel located horizontally across the top of a door (or window) opening to support the walls immediately above the opening and to provide a decorative curved architectural member.

Figure 6:
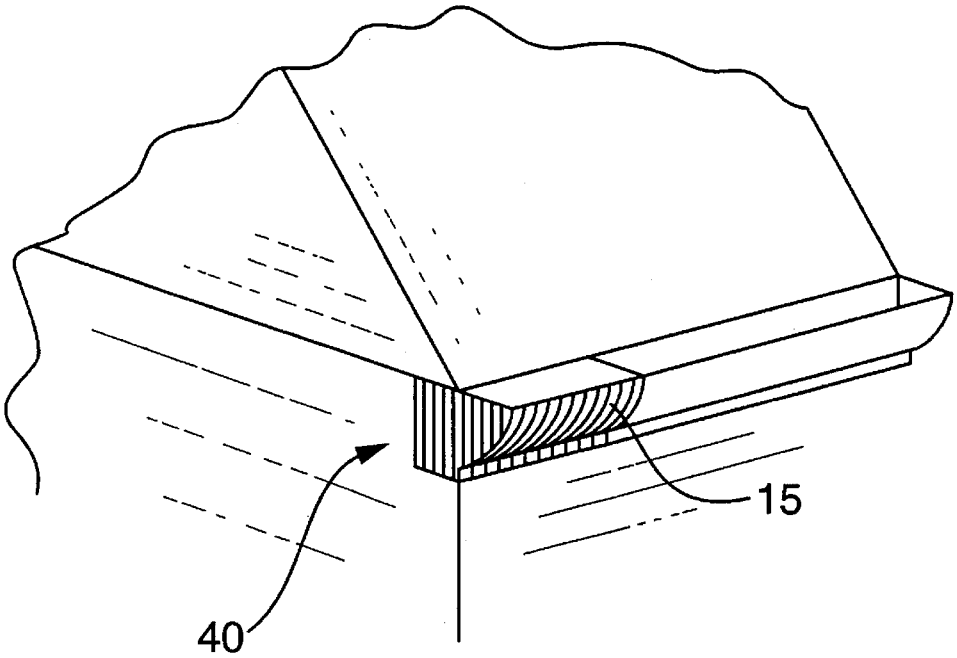
FIG. 6 is a perspective view showing a number of interlocking concrete forming blocks used to form a gutter along a roof line.

In FIG. 6, the forming block 40 is shown connected to the concrete forming blocks 10 to form a gutter along a roof line.

Alternately, the forming blocks 40 can be interlocked on top each other when the top block is inverted, such that the forming blocks 40 form a semi-circular surface (half moon) for decorative architectural purposes.

Accordingly, it will be understood that the preferred embodiment and alternative embodiment of the present invention have been disclosed by way of example and that other modifications and alterations may occur to those skilled in the art without departing from the scope and spirit of the appended claims.

What is claimed is:

1. A curved block formwork element for use in forming structures, comprising:

a substantially rectangular shaped block having two oppositely disposed side walls and two oppositely disposed end walls creating a hollow cavity inside, wherein a first of said side walls comprises a flat surface and a second of said side walls comprises a curved surface, said curved surface of said side wall comprising a quarter circular element having a closed circular bottom and an open horizontal top;

means for vertically interlocking said block with a plurality of rectangular block formwork elements along a top and bottom surface of said block; and means for horizontally interlocking said blocks.

2. The curved block formwork element of claim 1, wherein said vertical interlocking means comprises a plurality of top interlocking members along said top surface of said block and a plurality of bottom interlocking members which mirror said top interlocking members along said bottom surface of said block, whereby a top interlocking member of a lower rectangular block formwork element fits into said bottom interlocking members of said curved block when said blocks are stacked vertically, and whereby said top interlocking members of said curved block fits into a bottom interlocking members of an upper rectangular block formwork element when said blocks are stacked vertically.

3. The block formwork element of claim 2, further comprising a plurality of spaced strut members within said cavity for internal support of said block.

4. The block formwork element of claim 3, wherein said block is made of lightweight insulating material.

5. The block formwork element of claim 4, wherein said lightweight insulating material is expanded polystyrene.

6. A curved block formwork element for use in forming structures, comprising:

a substantially rectangular shaped block having two oppositely disposed side walls and two oppositely disposed end walls creating a hollow cavity inside, wherein a first of said side walls comprises a flat surface and a second of said side walls comprises a curved surface, wherein said curved surface of said side wall comprises a quarter circular element having a closed circular bottom and an open horizontal top;

means for vertically interlocking said block with a plurality of rectangular block formwork elements along a top and bottom surface of said block, comprising a plurality of top interlocking members along said top surface of said block and a plurality of bottom interlocking members which mirror said top interlocking members along said bottom surface of said block; and means for horizontally interlocking said blocks.

7. The block formwork element of claim 6, further comprising a plurality of spaced strut members within said cavity for internal support of said block.

8. The block formwork element of claim 7, wherein said block is made of lightweight insulating material.

9. The block formwork element of claim 8, wherein said lightweight insulating material is expanded polystyrene.

10. A plurality of block formwork elements for use in forming structures, comprising:

a plurality of substantially rectangular shaped blocks, wherein each of said blocks comprises two oppositely disposed side walls and two oppositely disposed end walls creating a hollow cavity inside;

a plurality of substantially rectangular shaped blocks wherein each of said blocks comprises two oppositely disposed side walls and two oppositely disposed end walls creating a hollow cavity inside, wherein a first of said side walls comprises a flat surface and a second of said side walls comprises a curved surface, said curved surface of said side wall comprising a quarter circular element having a closed circular bottom and an open horizontal top;

means for interlocking said block formwork elements vertically along a top and bottom surface of said block formwork elements; and means for interlocking said block formwork elements vertically.

11. The plurality of block formwork elements of claim 10, wherein said vertical interlocking means comprises a plurality of top interlocking members along said top surface of said block formwork elements and a plurality of bottom interlocking members which mirror said top interlocking members along said bottom surface of said block formwork elements, whereby said top interlocking member of a lower block formwork element fits into said bottom interlocking members of an upper block formwork element when said blocks are stacked vertically.

12. The plurality of block formwork elements of claim 11, further comprising a plurality of spaced strut members within said cavity for internal support of said block.

13. The plurality of block formwork elements of claim 12, wherein said block is made of lightweight insulating material.

14. The plurality of block formwork elements of claim 13, wherein said lightweight insulating material is expanded polystyrene.

15. A plurality of block formwork elements for use in forming structures, comprising:

a plurality of substantially rectangular shaped blocks, wherein each of said blocks comprises two oppositely disposed side walls and two oppositely disposed end walls creating a hollow cavity inside;

a plurality of substantially rectangular shaped blocks wherein each of said blocks comprises two oppositely disposed side walls and two oppositely disposed end walls creating a hollow cavity inside, wherein a first of said side walls comprises a flat surface and a second of said side walls comprises a curved surface, wherein said curved surface of said side wall comprises a quarter circular element having a closed circular bottom and an open horizontal top;

means for interlocking said block formwork elements vertically along a top and bottom surface of said block formwork elements, wherein said vertical interlocking means comprises a plurality of top interlocking members along said top surface of said block formwork elements and a plurality of bottom interlocking members which mirror said top interlocking members along said bottom surface of said block formwork elements, whereby said top interlocking member of a lower block formwork element fits into said bottom interlocking members of an upper block formwork element when said blocks are stacked vertically; and means for interlocking said block formwork elements horizontally.

* * * * *